US006550249B2

(12) United States Patent
Ponca et al.

(10) Patent No.: US 6,550,249 B2
(45) Date of Patent: Apr. 22, 2003

(54) CONDENSER NECK BETWEEN A STEAM TURBINE AND A CONDENSER

(75) Inventors: Daniel Ponca, Zürich (CH); Vaclav Svoboda, Birmensdorf (CH); Günter Schmalzbauer, Rheinfelden (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/900,943

(22) Filed: Jul. 10, 2001

(65) Prior Publication Data

US 2002/0005277 A1 Jan. 17, 2002

(30) Foreign Application Priority Data

Jul. 11, 2000 (DE) ..... 100 33 691

(51) Int. Cl.[7] ..... F01B 31/16
(52) U.S. Cl. ..... 60/685; 60/687
(58) Field of Search ..... 60/685, 686, 687

(56) References Cited

U.S. PATENT DOCUMENTS

| | | | | |
|---|---|---|---|---|
| 1,322,221 A | * | 11/1919 | Baumann | 60/687 |
| 2,848,197 A | | 8/1958 | Evans, Jr. et al. | |
| 2,939,685 A | | 6/1960 | Worn et al. | |
| 3,830,958 A | * | 8/1974 | Fuse et al. | 178/5.4 R |
| 3,854,909 A | * | 12/1974 | Hoisington et al. | 261/112.1 |
| 3,973,404 A | | 8/1976 | Iizuka et al. | |
| 4,433,546 A | | 2/1984 | Andrieux | |
| 5,018,572 A | | 5/1991 | Blangetti et al. | |
| 5,941,301 A | * | 8/1999 | Baumann | 165/114 |
| 6,332,320 B2 | * | 12/2001 | Kitz | 60/641.2 |

FOREIGN PATENT DOCUMENTS

| | | |
|---|---|---|
| DE | 100 05 727 | 9/2000 |
| EP | 0 957 325 | 5/1988 |
| EP | 0384200 A1 | 8/1990 |
| EP | 0953731 A1 | 11/1999 |
| GB | 691606 | 5/1953 |

* cited by examiner

*Primary Examiner*—Hoang Nguyen
(74) *Attorney, Agent, or Firm*—Burns, Doane, Swecker & Mathis, L.L.P.

(57) ABSTRACT

A condenser neck (1) comprises two level cover plates (2) and two side walls (3) located between them that are favorably shaped with respect to flow technology. The cover plates (2) and side walls (3) may be reinforced with ribs (4*a*,4*b*). A pipe (5) arranged between the cover plates (2) further reinforces the condenser neck (1). It would also be conceivable to provide openings (11) for bypass lines in the pipe (5) and/or in the side walls (3).

15 Claims, 2 Drawing Sheets

CONDENSER NECK BETWEEN A STEAM TURBINE AND A CONDENSER

This application claims priority under 35 U.S.C. §§119 and/or 365 to Appln. No. 100 33 691.4 filed in Germany on Jul. 11, 2000, the entire content of which is hereby incorporated by reference.

FIELD OF THE INVENTION

The invention relates to a condenser neck provided between a steam turbine and a condenser located downstream from the steam turbine.

BACKGROUND OF THE INVENTION

EP-A1-384 200 discloses an arrangement of a steam turbine and subsequent steam condenser. A coupling pipe and a condenser neck are located between the two elements that are located in one plane. The steam from the steam turbine is fed via the coupling pipe and condenser neck to the pipe bundle of the condenser. This condenser neck essentially has the task of providing a homogeneous flow field and a clean steam-flushing of the subsequent bundles of the condenser. The condenser neck of this steam condenser widens in a cone shape from the coupling pipe to the condenser.

Another embodiment of such a condenser neck is known from U.S. Pat. No. 2,939,685.

Also known are condenser necks that are comprised of level plates. Since very high vacuum forces act on the condenser neck, it is reinforced on the inside with pipes. Now and then, additional ribs are provided on the outside. These pipes are necessary, but significantly interfere with the flow of the steam. On the side of the pipes that faces away from the flow, oscillating vortices that are not very advantageous form and excite the support pipes and therefore the entire condenser neck. The result can be a failure of the reinforcement pipes, even a total failure of the system and damage of all involved components. During bypass operation, i.e., when hot steam is introduced directly into the condenser neck while bypassing the turbine, which occurs, for example, during a sudden shut-down of the turbine, there are overall difficulties in introducing the steam. There is a danger of erosion of the support pipes and walls. The large number of pipes used requires a complex assembly of the plates, pipes, and ribs with welding. Because it uses level plates, this type of condenser neck also has a shape with little advantages with respect to flow technology.

SUMMARY OF THE INVENTION

It is the objective of the invention to avoid the mentioned disadvantages. The invention solves the task of constructing a condenser neck with increased stability in relationship to external influences, whereby the flow of the steam is influenced or impaired as little as possible.

According to the invention, this is achieved by a condenser neck having two level cover plates and two side walls that widen in the flow direction of the steam and have a favorable shape with respect to flow technology.

This simple construction makes it possible that the forces acting on the condenser neck are absorbed in an improved manner. This is true in particular if the cover walls and/or side walls are reinforced with ribs. A pipe arranged between the cover walls is able to additionally support this reinforcement. The flow inside the condenser neck improves both because of the favorable shape as well as because previously known internal elements are eliminated. The existing pipe is preferably arranged so that it is located in a zone with little flow, so that the steam flow is influenced as little as possible. Any existing bypass lines may merge into the pipe as well as into the side and/or cover walls. If a compensator is provided between the turbine and the condenser, two connecting surfaces or connecting tabs are provided on the coupling pipe on the turbine side at the inlet opening; in this way the external loads are transmitted from the turbine side via a stabilized element onto the condenser casing. In an embodiment without compensator, the coupling pipe of the turbine is welded to the neck. The force in the condenser neck according to the invention is distributed evenly over its circumference.

BRIEF DESCRIPTION OF THE DRAWINGS

A preferred embodiment of the condenser neck according to the invention is described with reference to the accompanying drawings, in which.

Only those elements essential for the invention are shown. Identical elements are identified with the same reference numbers in different drawings. The flow directions are indicated by arrows.

DETAILED DESCRIPTION OF THE INVENTION

Figure 1:
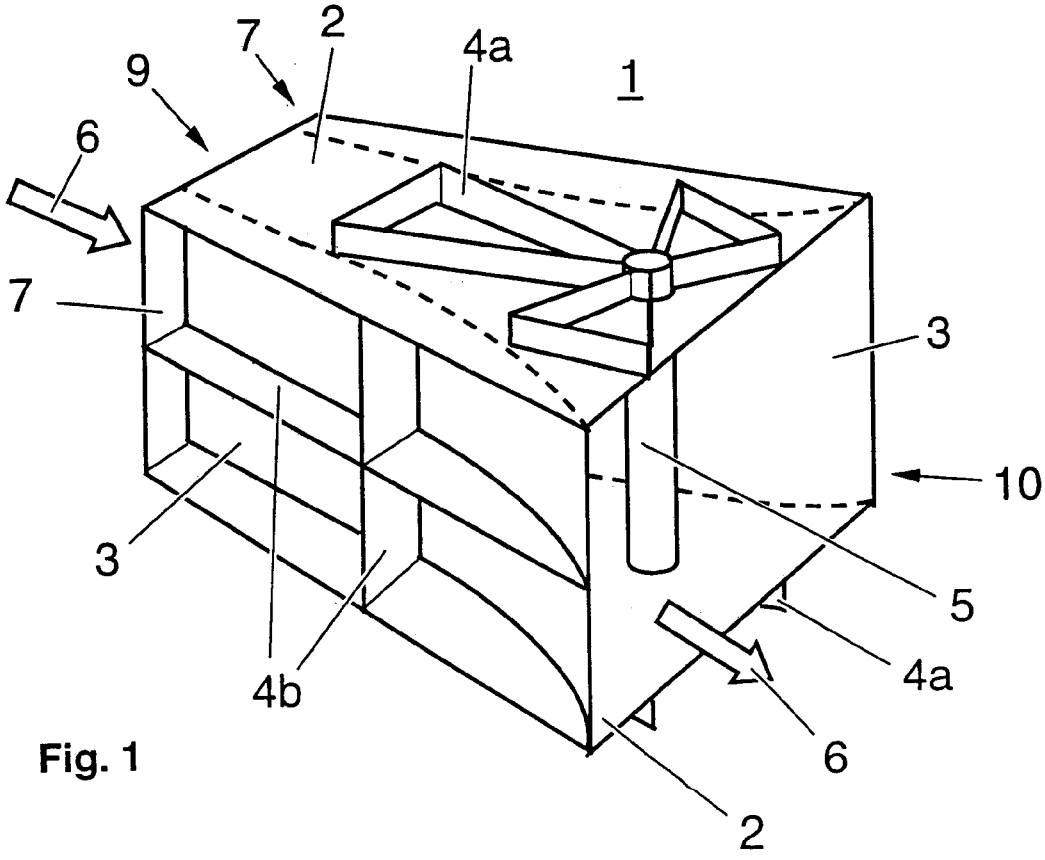
FIG. 1 is a perspective view of a condenser neck according to the invention.

FIG. 1 shows a perspective view of a condenser neck according to the invention that is located between a steam turbine (not shown) and a condenser (also not shown). The principal arrangement of these elements is known from document EP-A1-384 200 (FIG. 1). The condenser neck 1 according to the invention of FIG. 1 comprises two level cover plates 2 and two side walls 3 located between the cover plates 2. The side walls 3 widen between an inlet opening 9 an outlet opening 10 of the condenser neck 1 in a shape that is favorable with respect to flow technology, for example, as shown in FIG. 1, in the form of a nozzle, diffuser or similar form. The steam 6 flows in the direction of the arrow from the inlet opening 9 to the outlet opening 10.

Both the cover plates 2 and the side walls 3 are reinforced with ribs 4*a*, 4*b*. In addition, a vertical pipe 5 is provided centered between the cover plates 2 in the condenser neck 1, which also functions as a reinforcement of the condenser neck 1. The pipe 5 is provided approximately in the last third towards the outlet opening 10 of the condenser neck 1. This means that the pipe 5 is installed at a point at which it has only a slight influence on the steam flow. At the cover plates 2, the ribs 4*a* are arranged in a star shape around the pipe 5. The horizontal ribs 4*b* of the side walls 3 are oriented approximately parallel to the (main) flow direction of the steam 6. The vertical ribs 4*b* are perpendicular to the horizontal ribs 4*b*. Naturally, the number of shown ribs 4*a*, 4*b* is used only as an example. They may vary in relation to the specific design (size, specifications for stability, etc.) of the condenser neck 1. The horizontal ribs 4*b* in this case have a reinforcing effect. The side walls 3 have been installed so that on the inlet opening 9 one each connecting surface 7 is created on the side. These connecting surfaces 7 are used for attachment on the turbine side, and therefore also for absorbing external loads. Forces from the turbine side due to vacuum, ground vibration, piping, or other causes are transmitted via the connecting surface 7 and are absorbed, in particular, by the reinforced side walls 3 or cover plates 2 and then transmitted to the condenser casing (not shown). In the condenser neck 1 according to the invention, the applied force in this manner is distributed evenly over the circumference. The condenser neck 1 can be used in connection with an axial or lateral arrangement of the steam turbine and condenser.

Figure 3:
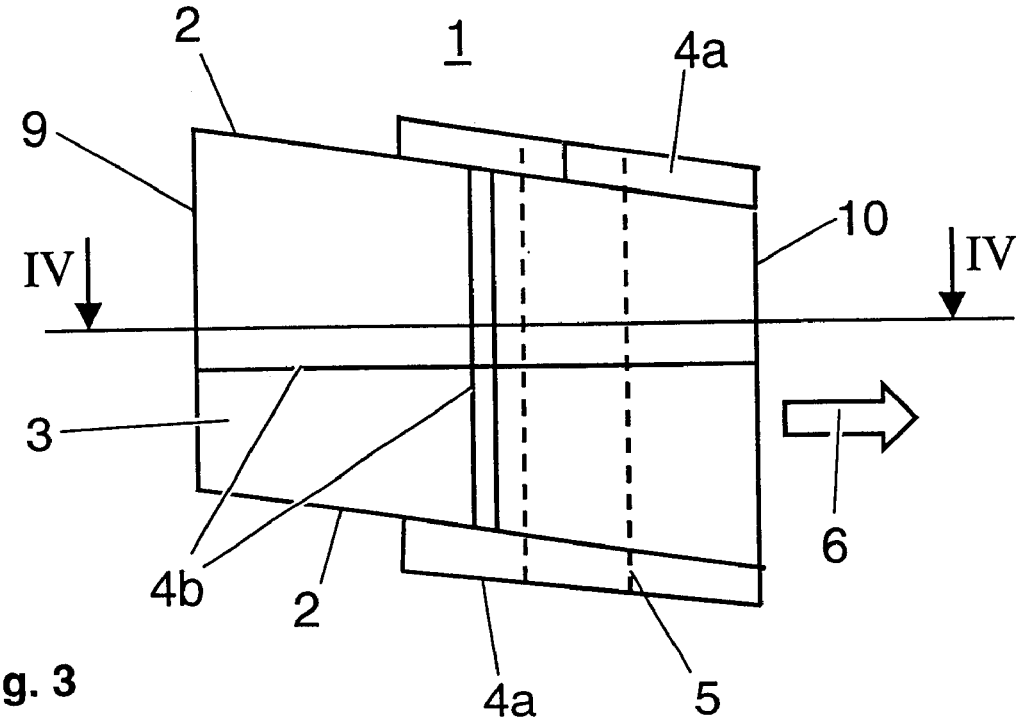
FIG. 3 is a side elevational view of the condenser neck according to the invention; and, FIG. 4 is a cross-sectional view along the line IV—IV in FIG. 3 with openings for a bypass line.
Figure 2:
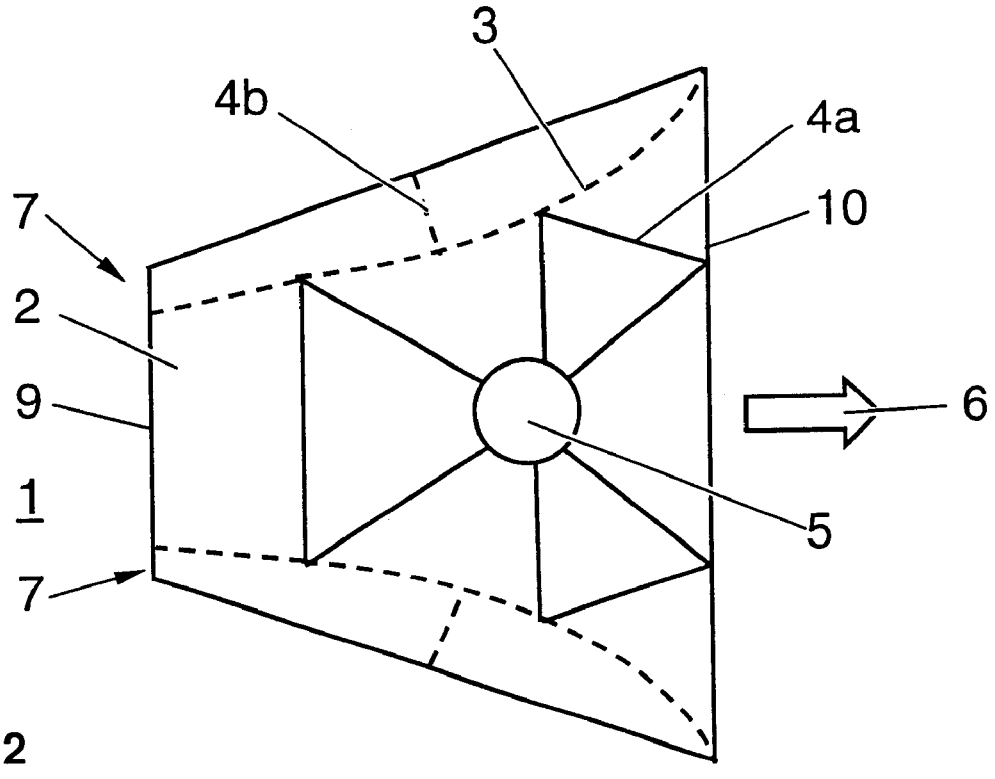
FIG. 2 is a top plan of the condenser neck according to the invention.

FIGS. 2 and 3 show two more views of the condenser neck 1. FIG. 2, which is a view from the top, clearly shows the star-shaped arrangement of the ribs 4*a* on the condenser neck 1 around the pipe 5, and the shape of the side walls 3 that is favorable with respect to the flow. FIG. 3 shows a lateral view of the condenser neck 1.

Figure 4:
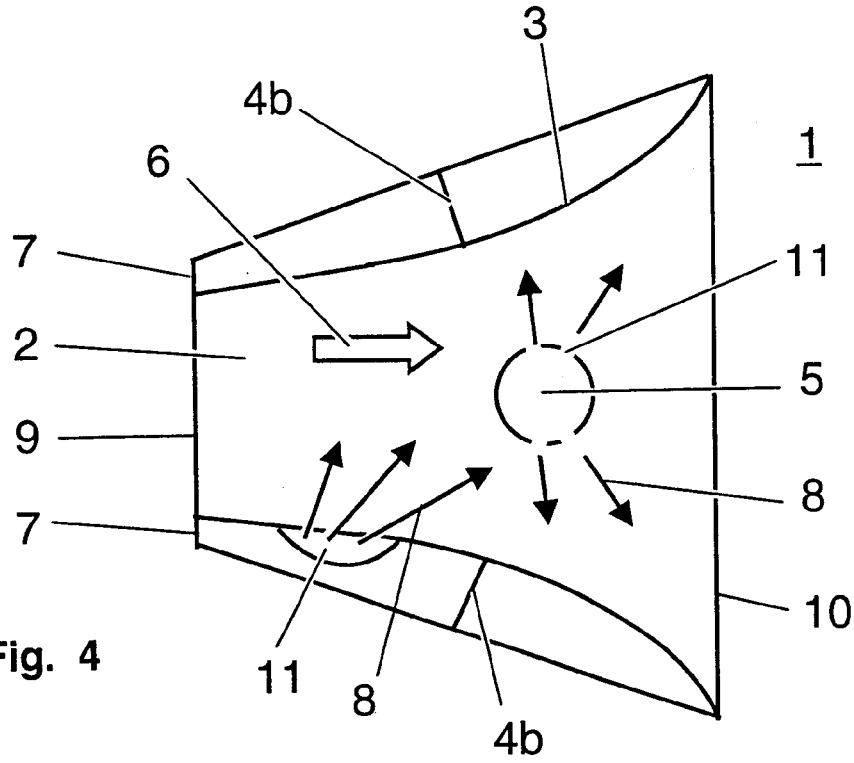

FIG. 4 shows a section according to line IV—IV in FIG. 3 through the condenser neck 1 according to the invention. It is obvious that both the pipe 5 as well as the side walls 3 and/or cover walls 2 may be provided with openings 11 connected to a bypass line (not shown). In the case of a turbine shutdown, these bypass lines feed the steam directly into the condenser, bypassing the turbine in the process. Since the number of internal elements is clearly reduced in comparison to the state of the art, the danger of erosion due to the introduced steam is reduced. The centered arrangement of the pipe 5 also reduces the risk of an erosion of the side walls 3. The arrangement of openings 11 for the bypass lines in the pipe 5 is also advantageous because it provides a very large surface for this purpose.

What is claimed is:

1. Condenser neck provided between a steam turbine and condenser, used to feed steam from the steam turbine to the condenser and provided with an inlet opening and an outlet opening, wherein the condenser neck comprises two level cover plates and two side curved walls widening in the flow direction of the steam, and wherein at least one of the cover plates and/or at least one of the side walls is reinforced with ribs.

2. Condenser neck as claimed in claim 1, wherein a pipe is provided between the cover plates.

3. Condenser neck as claimed in claim 2, wherein the ribs of the at least one cover plate are arranged in star shape around the pipe.

4. Condenser neck as claimed in claim 2, wherein the pipe is arranged centered between the cover plates between the side walls in the back third towards the outlet opening.

5. Condenser neck as claimed in claim 1, wherein openings, into which a bypass line merges, are provided in at least one cover plate and/or in at least one side wall and/or the pipe located between the cover plates.

6. Condenser neck as claimed in claim 1, wherein connecting surfaces are provided at the inlet opening, laterally towards the side walls.

7. Condenser neck as claimed in claim 6, wherein the condenser neck is used with an axial arrangement of steam turbine and condenser.

8. A condenser neck for the flow of steam in a flow direction, comprising:

an inlet opening for entry of a steam flow;

an outlet opening for exit of a steam flow;

two cover plates separated by two side walls, said two side curved walls widening in the flow direction of the steam, wherein at least one of the cover plates or at least one of the side walls is reinforced with ribs.

9. The condenser neck of claim 8, wherein at least one of the cover plates and at least one of the side walls is reinforced with ribs.

10. The condenser neck of claim 9, further comprising:

a pipe disposed between the cover plates.

11. The condenser neck of claim 8, wherein the ribs of at least one cover plate are arranged in star shape around the pipe.

12. The condenser neck as claimed in claim 10, wherein the pipe is arranged centered between the cover plates between the side walls in the back third towards the outlet opening.

13. The condenser neck of claim 8, wherein openings, into which a bypass line merges, are provided in at least one cover plate and/or in at least one side wall and/or the pipe located between the cover plates.

14. The condenser neck of claim 8, wherein connecting surfaces are provided at the inlet opening, laterally towards the side walls.

15. The condenser neck of claim 14, wherein the condenser neck is axially aligned with a steam turbine and a condenser.

* * * * *